US005717280A

United States Patent [19]

Lee

[11] Patent Number: 5,717,280

[45] Date of Patent: Feb. 10, 1998

[54] HOOK SPRING OF SHADOW MASK FRAME ASSEMBLY FOR COLOR CATHODE RAY TUBE

[75] Inventor: Sun-heang Lee, Kyungki-do, Rep. of Korea

[73] Assignee: Samsung Display Devices Co., Ltd., Kyungki-do, Rep. of Korea

[21] Appl. No.: 580,412

[22] Filed: Dec. 28, 1995

[30] Foreign Application Priority Data

Dec. 29, 1994 [KR] Rep. of Korea ..... 94-38987

[51] Int. Cl.[6] ..... H01J 29/07

[52] U.S. Cl. ..... 313/404; 313/405

[58] Field of Search ..... 313/402, 404, 313/405, 406, 407

[56] References Cited

U.S. PATENT DOCUMENTS 4,792,719 12/1988 Ornstein ..... 313/405

5,502,350 3/1996 Uehara et al. ..... 313/404

*Primary Examiner*—Sandra L. O'Shea

*Assistant Examiner*—Vip Patel

*Attorney, Agent, or Firm*—Leydig, Voit & Mayer, Ltd.

[57] ABSTRACT

A hook spring of a shadow mask frame assembly for a cathode ray tube is formed by joining two metals having different thermal expansion coefficients over a predetermined range of temperatures. One ends of the hook spring is coupled with a stud pin installed at the inner side of a panel and the other end is coupled with a circumferential surface of a frame. The two metals are stainless steel and N48, and a volume ratio of the stainless steel and N48 is 5:5 to 6:4. Excessive compensation for thermal expansion of the shadow mask frame assembly can be reduced in the range of 80°~120° C.

3 Claims, 4 Drawing Sheets

HOOK SPRING OF SHADOW MASK FRAME ASSEMBLY FOR COLOR CATHODE RAY TUBE

BACKGROUND OF THE INVENTION

The present invention relates to a shadow mask frame assembly for a cathode ray tube, and more particularly, to a hook spring for supporting the shadow mask frame assembly and simultaneously compensating for gap variations between a fluorescent film and shadow mask due to thermal expansion of the shadow mask.

Generally, as shown in FIG. 1, a color cathode ray tube (CRT) comprises a panel 10 on the inner side of which a fluorescent film 1i is formed, a funnel 20 sealedly coupled to panel 10 with an electron gun 23 and a deflecting yoke 24 being installed at a neck portion 21 and a cone portion 22 thereof, respectively, and a shadow mask frame assembly 30 having a shadow mask 31 installed inside panel 10 and having a color selecting function of an electron beam radiated from electron gun 23 and a frame 32 for supporting shadow mask 31.

In the color CRT of such a structure, the electron beam radiated from electron gun 23 passes through electron beam passing holes (not shown) of shadow mask 31 and forms an image while landing at a fluorescent point of fluorescent film 11.

To accurately land the electron beam radiated from electron gun 23 onto the fluorescent point of fluorescent film 11, a supporting state of shadow mask 31, that is, a displacement interval (θ) between the fluorescent film 11 formed on the inner side of panel 10 and shadow mask 31 should be strictly controlled.

Not all the electron beam radiated from electron gun 23 passes through the aperture formed on shadow mask 31, i.e., only about 15 to 20% thereof passes through the aperture. The thermions in the electron beam, which do not pass through the aperture collide with shadow mask 31 to heat shadow mask 31, thereby causing a doming phenomenon. As a result, shadow mask 31 undergoes thermal expansion, thus displacing the aperture formed thereon. Accordingly, the electron beam passing through the aperture of shadow mask 31 does not accurately land at the fluorescent point of the fluorescent film.

To overcome the above troubles, as shown in FIG. 2, a hook spring 40, coupled with a stud pin 15 installed at the interior of panel 10 and also fixed to the circumferential surface of frame 32 of shadow mask frame assembly 30, is manufactured in the form of a bimetal made of a juncture of stainless steel 41 and Invar 42 having different thermal expansion coefficients from each other. Thus, the doming phenomenon according to the thermal expansion is compensated for.

As a CRT becomes flattened and enlarged, the doming amount of shadow mask 31 is reduced by manufacturing shadow mask 31 with Invar having a low thermal expansion coefficient. Thus, when a hook spring of the above-described bimetal type which is made of stainless steel and Invar is employed, the compensation for displacement according to the thermal expansion of the shadow mask frame assembly is excessive within CRT operating temperatures of 100°~120° C.

That is, as shown in Table 1, when the stainless-to-Invar volume ratio of the hook spring is 7:3 or 8:2, the displacement of the electron beam deviated from a preset track when passing the aperture which is displaced due to the doming of the shadow mask according to the thermal expansion thereof is beyond ±10 μm, which is a test standard of for CRT's within a range of 100°~120° C. Such a phenomenon indicates that the compensation by the conventional hook spring for the thermal expansion of the shadow mask frame assembly is excessive made.

TABLE 1

| RATIO | DISPLACEMENT AT TEMPERATURE A | DISPLACEMENT AT TEMPERATURE B | REMARKS |
|---|---|---|---|
| 5:5 | +50 μm | — | inferior |
| 6:4 | +20 μm | — | inferior |
| 7:3 | +5 μm | +20 μm | inferior |
| 8:2 | 0 | +15 μm | inferior |
| 9:1 | −10 μm | — | inferior |

In Table 1, the amount of displacement of the electron beam deviated from the preset track after passing through the displaced aperture of the shadow mask is shown for the cases where the CRT operating temperature is 80° C. (temperature A) and 100°~120° C. (temperature B).

The above excessive compensation can be prevented by adjusting the ratio of cross sections of the metals constituting the hook spring. However, since the degree of thermal expansion of each metal is different within a particular temperature range, a difference in the compensation amount within the range of compensation temperatures occurs. Thus, it is a problem that the compensation for the doming phenomenon varies according to temperature.

SUMMARY OF THE INVENTION

To solve the above problems, it is an object of the present invention to provide a hook spring of a shadow mask frame assembly, by which differences in compensation amounts within the range of compensation temperatures can be reduced.

Accordingly, to achieve the above object, there is provided a hook spring of a shadow mask frame assembly for a cathode ray tube which is formed by uniting two metals having different thermal expansion coefficients over a predetermined range of temperatures. One end of the hook spring is coupled with a stud pin installed at the inner side of a panel and the other end is coupled with the circumferential surface of a frame. The two metals are stainless steel and N48, and a volume ratio of the stainless steel and N48 is 5:5 to 6:4.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
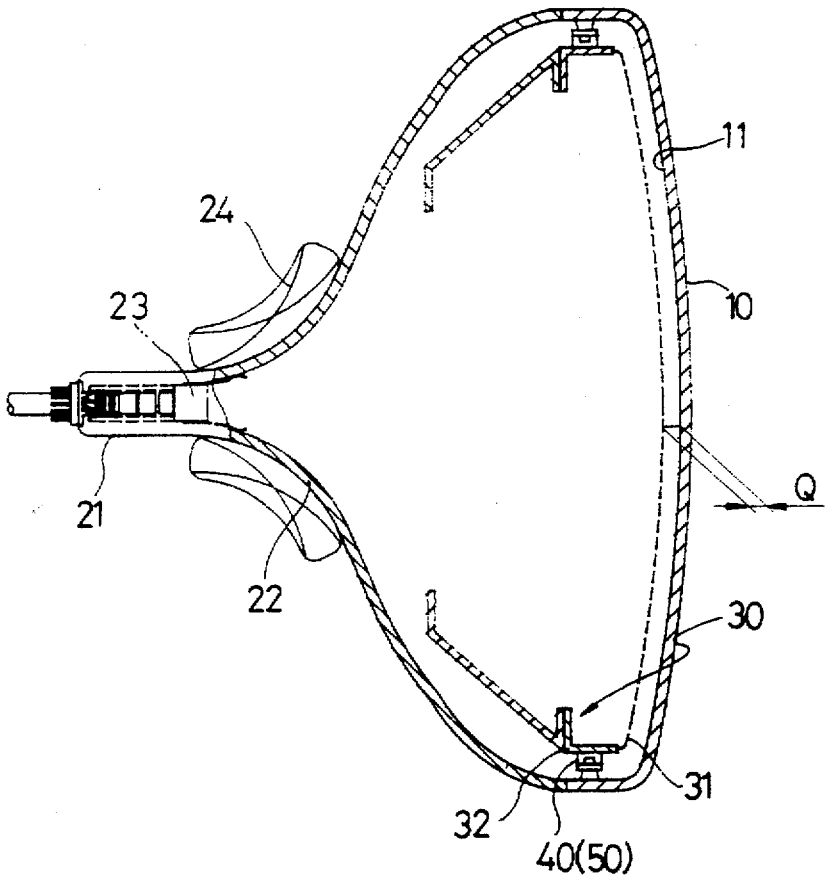
FIG. 1 is a cross section of a CRT.
Figure 2:
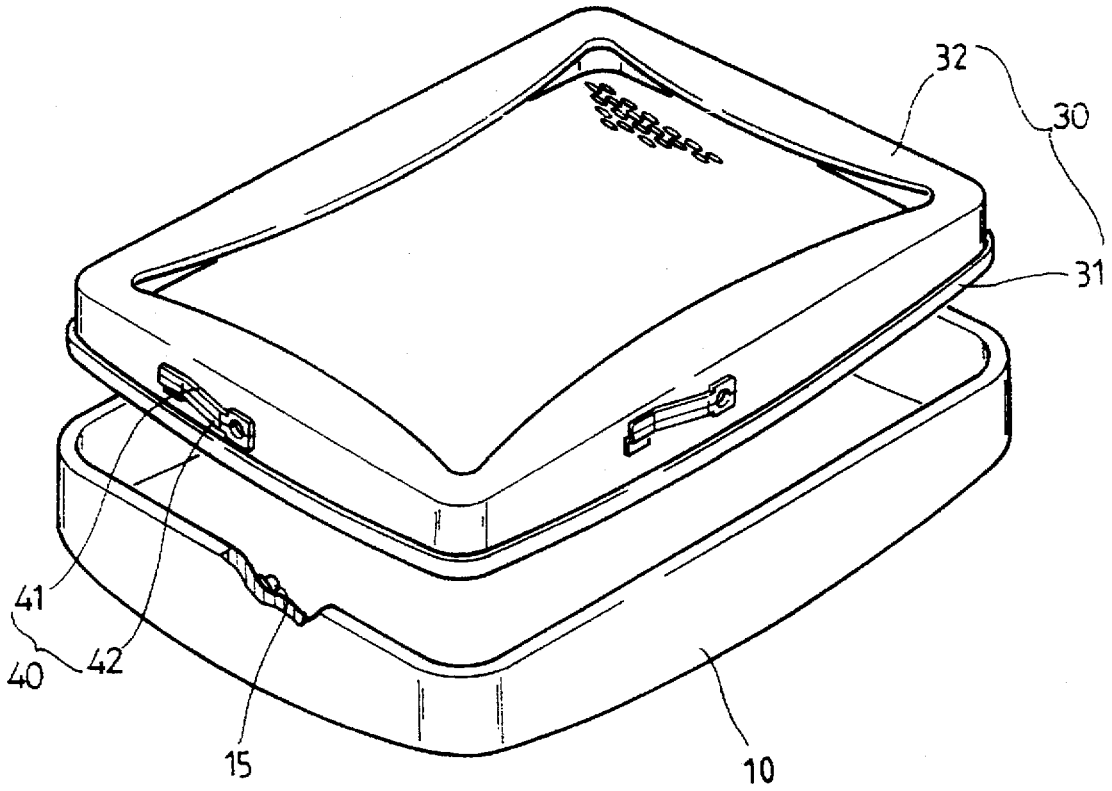
FIG.2(PRIOR ART)
FIG. 2 is an exploded perspective view showing the state where a shadow mask frame assembly is installed inside a panel.

As shown in FIG. 1, a color CRT comprises a panel 10 on the interior of which a fluorescent film 11 is formed and a stud pin 15 is installed, a funnel 20 sealedly coupled with panel 10 and provided with an electron gun 23 and deflection yoke 24, respectively, at a neck portion 21 and cone portion 22 thereof, a shadow mask frame assembly 30 fixed to the interior of panel 10, and a hook spring 50, opposite ends of which are coupled with stud pin 15 and the circumferential surface of frame 32 of shadow mask frame assembly 30, respectively.

Figure 3:
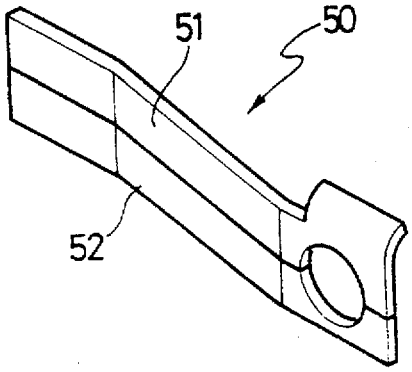
FIG. 3 is a perspective view illustrating a hook spring according to the present invention.

The hook spring 50 is made of bitmetal each component of which has a different thermal expansion coefficient. As shown in FIG. 3, the bimetal hook spring 50 is comprised of a first member 51 formed of stainless steel and a second member 52 formed of N48, being mutually united. A volume ration of the two metals is preferably 5:5 through 6:4. Here, material N48 (manufactured by Métalimphy Produits of France) is an alloy consisting essentially of, in weight %, at most 0.02% C, at most 0.25% Si, 0.3–0.6% Mn, at most 0.007% P, at most 0.002% S, 47–48.5% Ni, and a balance of Fe.

The operation of the hook spring having such a structure according to the present invention will now be described.

Figure 4:
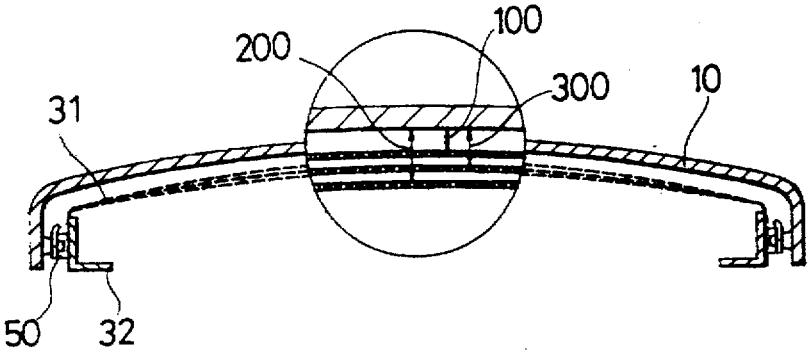
FIG. 4 is a cross section illustrating a state where compensation for displacement due to thermal expansion of the shadow mask frame assembly is achieved.

In the color CRT adopting the hook spring according to the present invention, an electron beam radiated from electron gun 23 passes through the aperture formed in shadow mask 31 of shadow mask frame assembly 30. Then, the beam lands on the fluorescent film of panel 10 and forms an image by exciting the fluorescent film. In doing so, shadow mask frame assembly 30, being heated by thermions which do not pass through the aperture of the shadow mask, undergoes thermal expansion. The thermal expansion of shadow mask frame assembly 30 causes the doming phenomenon of the shadow mask 31 as shown in FIG. 4 and, the displacement interval decreases to the amount shown by reference numeral 100. On the other hand, as frame 32 for supporting shadow mask 31 is thermally expanded by means of the heat transferred from shadow mask 31, the displacement interval increases to the amount shown by reference numeral 200. While the thermally expanded hook spring transfers the shadow mask frame assembly 30 toward panel 10, the displacement interval alters to the amount shown by reference numeral 300.

Figure 5:
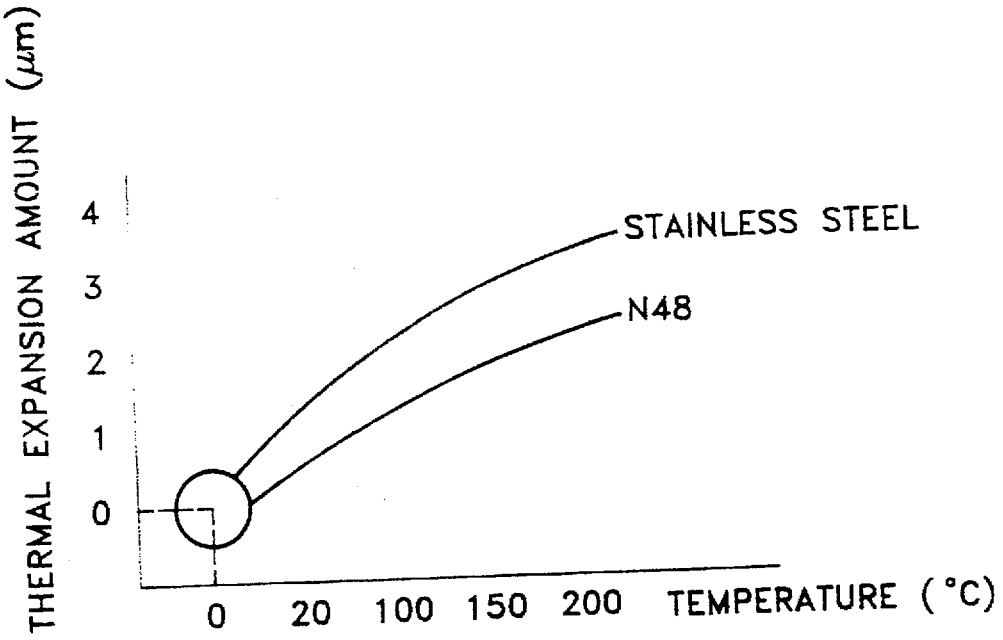
FIG. 5 is a graph indicating the relationship of the thermal expansion amount and temperature of first and second members of the hook spring.

Here, when the volume ratio of a first member 51 formed of stainless steel which is a high thermal-expansion metal and a second member 52 formed of N48 which is a low thermal-expansion metal is adjusted to 5:5~6:4, the excessive compensation of the shadow mask frame assembly can be reduced during CRT operation. That is, since first and second members 51 and 52 of the hook spring 50 each have a slightly different slope of temperature as shown in FIG. 5, variation in the compensation amount throughout the operating temperature range of the CRT can be reduced. Thus, a rapid change of the compensation amount within the compensation temperatures of 100°~120° C. can be prevented.

The results of experiments carried out by the present inventor are shown in Table 2. Here, stainless steel and N48 are united using four different volume ratios (stainless steel-to-N48).

TABLE 2

| RATIO | DISPLACEMENT AT TEMPERATURE A | DISPLACEMENT AT TEMPERATURE B | REMARKS |
|---|---|---|---|
| 5:5 | 0 | +5μm | superior |
| 6:4 | −5μm | +1μm | superior |
| 7:3 | −20μm | — | inferior |
| 8:2 | −25μm | — | inferior |

In Table 2, as in Table 1, the amount of displacement of the electron beam deviated from the preset track after passing through the displaced aperture of the shadow mask is shown for the cases when the CRT operation temperature is 80° C. (temperature A) and 100° C.~120° C. (temperature B).

It is noted from the above result that when the volume ratio of stainless steel (i.e., a high thermal expansion metal) and N48 (i.e., a low thermal expansion metal) in the hook spring is 5:5 and 6:4, the experimental result is superior. Particularly, when the ratio is 5:5, the displacement amount of the electron beam due to thermal expansion of the shadow mask is minimized to 0 μm and +5 μm at 80° C. and 100°~120° C., respectively.

As described above, the hook spring of the shadow mask frame assembly of the present invention using stainless steel and N48 can improve compensation of the doming of the shadow mask. Also, the resolution of a CRT adopting the present invention is enhanced.

What is claimed is:

1. A hook spring of a shadow mask frame assembly for a cathode ray tube, which is formed by joining two metals having different thermal expansion coefficients over a predetermined range of temperatures, one end of the spring being coupled with a stud pin installed at an inner side of a panel and another end of the spring being coupled with a circumferential surface of a frame, wherein the two metals are stainless steel and an alloy consisting essentially of, in weight %, at most 0.02% C, at most 0.25% Si, 0.3–0.6% Mn, at most 0.007% P, at most 0.002% S, 47–48.5% Ni, and a balance of Fe, and a volume ratio of the stainless steel and the alloy is 5:5 to 6:4.

2. A hook spring of a shadow mask frame assembly for a cathode ray tube as claimed in claim 1, wherein the volume ratio of stainless steel and the alloy is 5:5.

3. A hook spring of a shadow mask frame assembly for a cathode ray tube as claimed in claim 1, wherein said predetermined range of temperatures is 80°~120° C.

* * * * *